United States Patent [19]

Dlugosz

[11] Patent Number: 4,940,364

[45] Date of Patent: Jul. 10, 1990

[54] CONCRETE CONSTRUCTION UNITS AND MULTI-PLY CONCRETE COMPOSITES MADE THEREFROM

[76] Inventor: Leonard T. Dlugosz, 4 Minden Dr., Orchard Park, N.Y. 14127

[21] Appl. No.: 257,641

[22] Filed: Oct. 14, 1988

[51] Int. Cl.[5] ..... E02D 27/01

[52] U.S. Cl. ..... 405/229; 405/19; 405/258; 52/576

[58] Field of Search ..... 405/15–20, 405/258, 270, 229; 52/2 E, 576, 577

[56] References Cited

U.S. PATENT DOCUMENTS

| | | | |
|---|---|---|---|
| 1,953,410 | 4/1934 | Jacobson | 52/576 X |
| 3,229,437 | 1/1966 | Adie | 52/576 |
| 3,234,741 | 2/1966 | Ionides | 405/270 |
| 3,466,685 | 9/1969 | Robinsky | 52/2 X |
| 3,957,098 | 5/1976 | Hepworth et al. | 405/19 X |
| 4,132,577 | 1/1979 | Wintermantel | 264/314 X |
| 4,592,675 | 6/1986 | Scales et al. | 405/19 |
| 4,635,576 | 1/1987 | Bowers | 112/403 |
| 4,690,585 | 9/1987 | Holmberg | 405/19 |

FOREIGN PATENT DOCUMENTS

| | | | |
|---|---|---|---|
| 1931537 | 8/1978 | Fed. Rep. of Germany | 405/19 |
| 1094305 | 12/1954 | France | 52/576 |
| 0118907 | 7/1984 | Japan | 405/19 |
| 894675 | 4/1962 | United Kingdom | 405/19 |
| 940687 | 10/1963 | United Kingdom | 405/222 |
| 2156941 | 10/1985 | United Kingdom | 405/19 |

*Primary Examiner*—Dennis L. Taylor

*Attorney, Agent, or Firm*—Howard M. Ellis

[57] ABSTRACT

Generally mat shaped concrete construction units provide novel, versatile building materials particularly for flexible multi-ply concrete composites in pavement or floor construction, roadbeds, driveways, waste disposal sites, etc. The mat-like structures comprise an outer shell subdivided into parallel tubular compartments which are filled with dry concrete mix so as to provide controlled chemical hydration for greater strength and durability. The multi-ply structures fabricated with the concrete construction units exhibit enhanced resistance to fracturing and possess residual structural values not found in equivalent poured concrete structures.

27 Claims, 5 Drawing Sheets

Fig. 1.
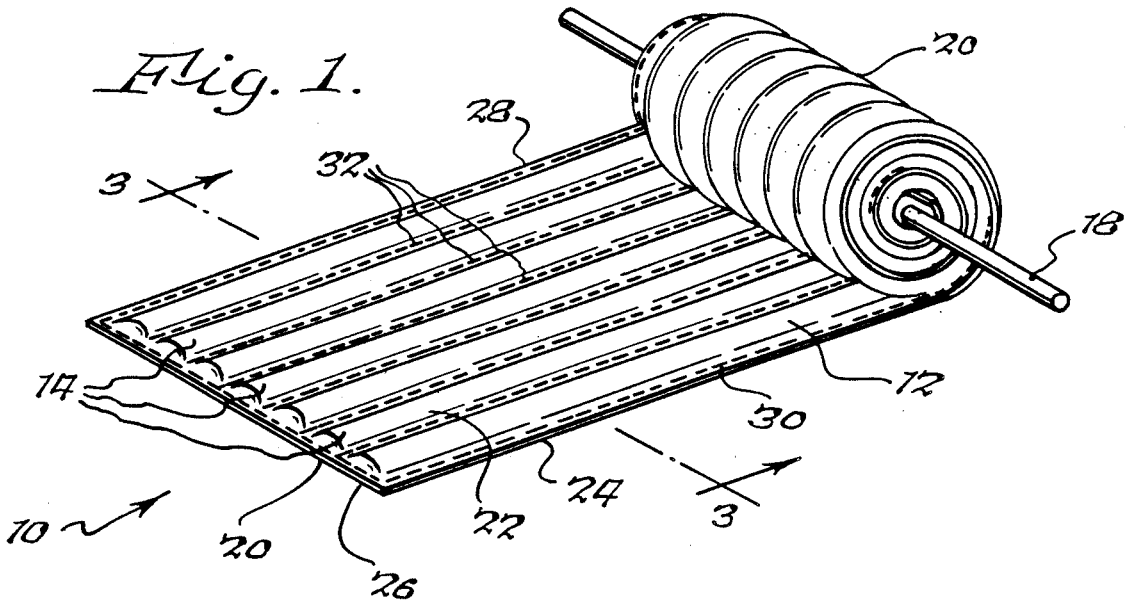
Fig. 2.
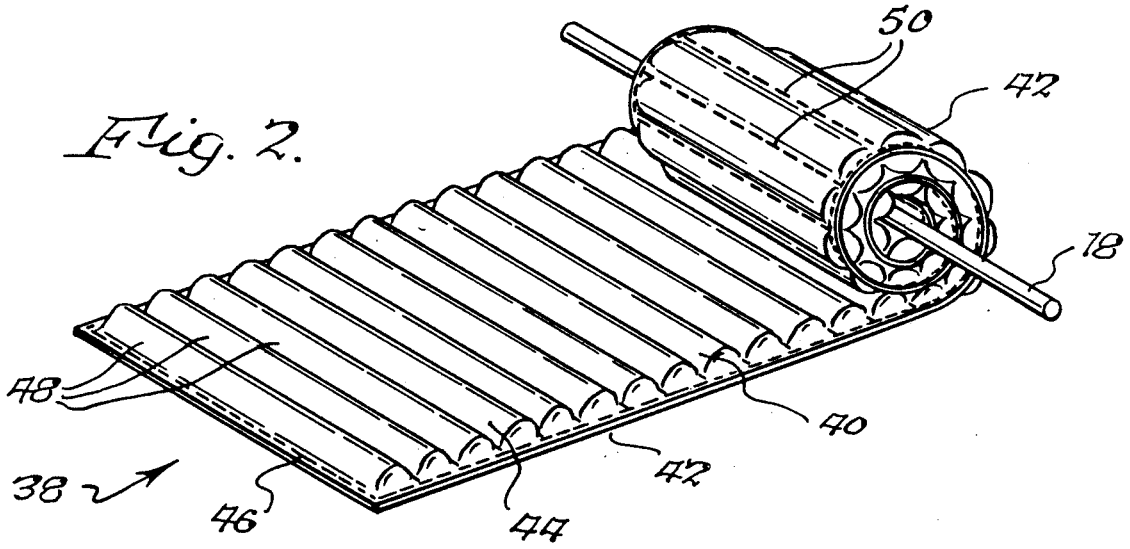
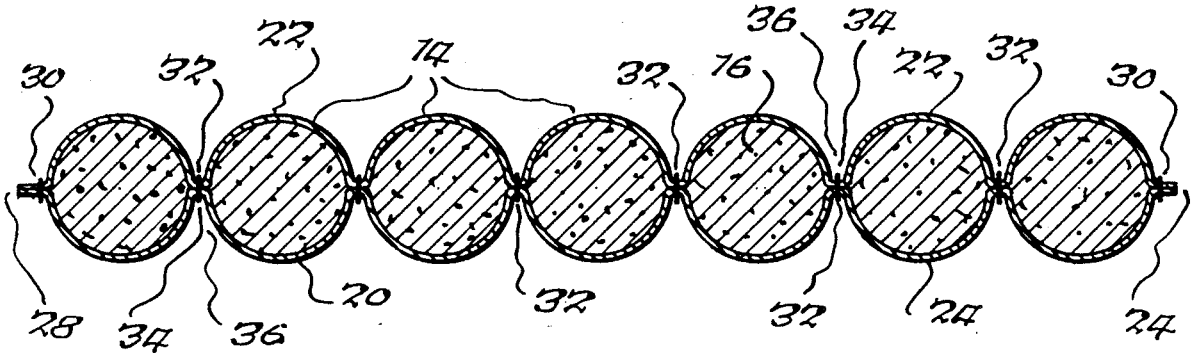
Fig. 3.

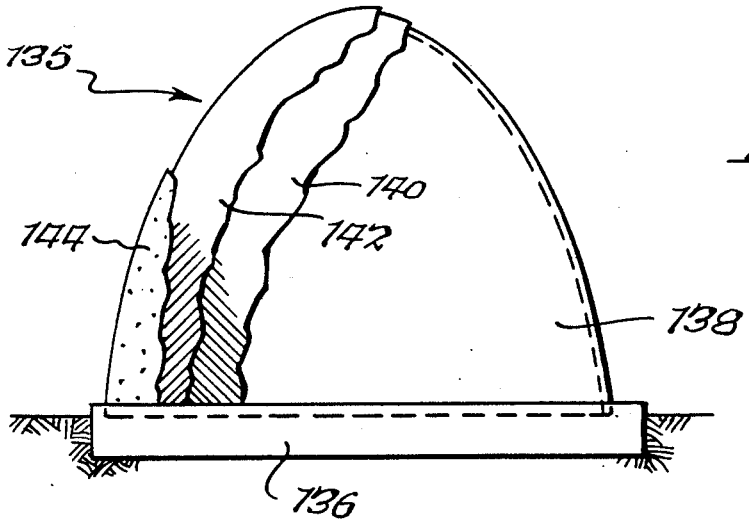
Fig. 13.
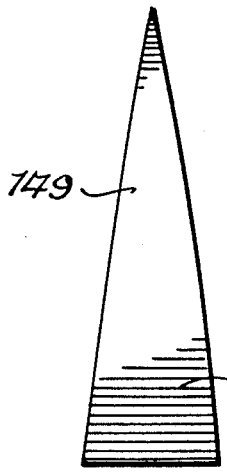
Fig. 16.
Fig. 14.
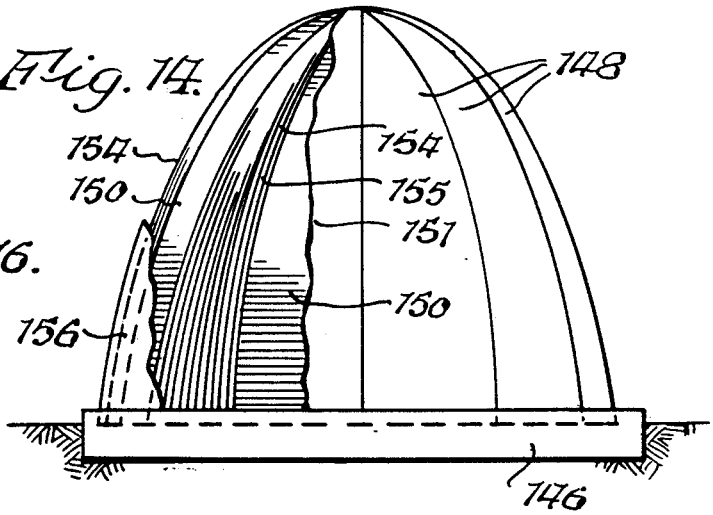
Fig. 15.
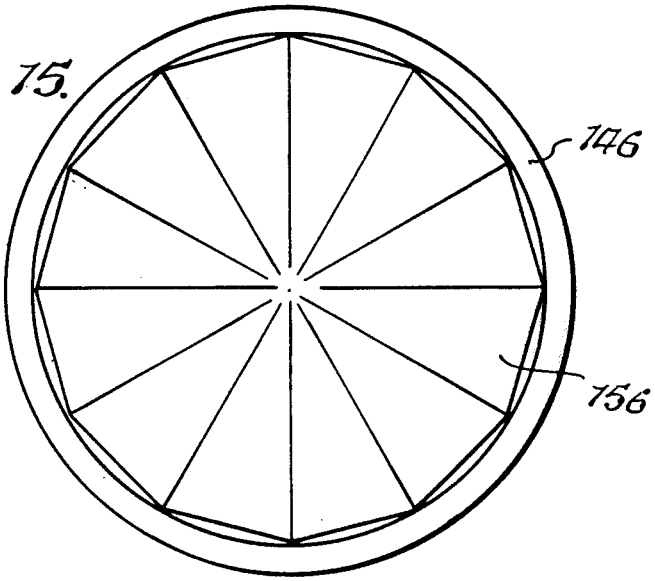
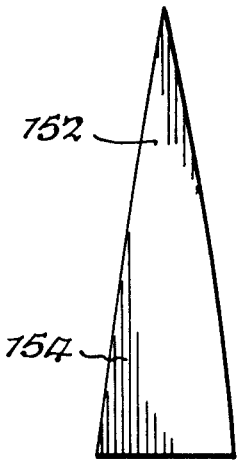
Fig. 17.

COMPRESSIVE TESTS
6"X6"X6" CUBES
STRESS - STRAIN CURVES

SAMPLE 3
(PLY, PARALLEL GRAIN)
SAMPLE 2
(PLY, CROSS GRAIN)
SAMPLE 1
(REGULAR)
ASSUMED PATH
SAMPLE 3
SAMPLE 2
SAMPLE 1
TOTAL COMPRESSION, 1/1000 INCH
LOAD, 1000 lbs.
0
20
40
60
80
100
120
140
100
200
300
400

CONCRETE CONSTRUCTION UNITS AND MULTI-PLY CONCRETE COMPOSITES MADE THEREFROM

BACKGROUND OF THE INVENTION

The present invention relates generally to improved building materials, and more specifically, to concrete construction units having enhanced structural values, including load bearing properties and resistance to fracturing. Porous mat-like structures subdivided into adjacent, cyclindrically shaped concrete bodies provide a highly versatile and economic unit of construction which can be used in fabricating wall panels, building foundations, domes and roofing; poles, pillars and bridge supports; pavement and floor construction, including beds for roads, driveways, foundations for waste disposal sites, etc. Such structures exhibit flexural characteristics , and therefore, have residual strength and extended life expectancies.

In fabricating concrete monolithic structures, such as walls, panels, pavements, support columns, etc., generally two steps are customarily followed. The first involves pouring a concrete mass into a form, followed by stripping the form once the mass has set-up. Concrete forms, however, are costly and labor intensive in fabricating and stripping. Monolithic, homogeneous concrete masses prepared from poured concrete are also structurally vulnerable to changes in weather, including rain, temperature extremes, frost upheaval; shock and natural disasters like tremors, earthquakes, etc., and because poured concrete lacks the ability to flex under stresses of load and impact, fractures can lead to early failure. For example, tank farm pads which support very heavy loads of gasoline, oil, chemicals, etc., are subject to freeze upheaval and impact. Consequently, conventional monolithic concrete pads are subject to fracture, and because residual structural values may be lacking will continue to striate, leading to instability and potential for leaking contents from storage tanks.

Because of the sensitivities of monolithic poured concrete structures unit size limitations become necessary to minimize the effect of fractures. Heretofore, whenever expanse and size of poured concrete structures exceeded minimal proportions, expansion joints, steel reinforcements, etc., were required. While the strength of concrete can be improved by reducing the ratio of mixing water to cement this approach has proven to be of little actual value because flow properties and placement of poured concrete can be adversely affected.

Others have attempted to fabricate improved concrete construction units by encasing concrete mix in flexible containers. U.S. Pat. No. 3,922,832 (Dicker), and U.S. Pat. No. 2,095,989 (Lillard) each disclose individual sack type construction units containing dry concrete mix. The Lillard patent discloses a sack fabricated from thin, inexpensive cloth, such as cotton muslin or cheese cloth preferably soaked in paraffin as a moisture barrier for the dry mix during storage. However, the wax barrier restricts the amount of water entering the sack at the time of hydration, and consequently, each sack must be perforated in order to hydrate the mix. Lillard also describes individual concrete sacks without a paraffin moisture barrier, but because of the overall bulk size of the filled sacks manual kneading is required to insure the cement in the center of the sack is suitably hydrated.

The patent to Dicker (U.S. Pat. No. 3,922,832) also discloses individual porous sacks of dry concrete mix as horizontal wall construction units. Insulating and acoustical fillers may also be used. Successive units are superimposed on each other in a sandbag-like arrangement. The units can be positioned before wetting or can be wet just prior to being laid. In hydrating these construction units the amount of water applied is based on the trained observations of the worker, who must not exceed a maximum amount which will cause a predetermined "slump" or spreading out of the construction unit.

Representative mat-like units are disclosed by U.S. Pat. Nos. 4,405,257 (Nielsen); 3,561,219 (Nishizawa et al); 3,837,169 (Lamberton) and 3,696,623 (Heine et al). Nielsen (U.S. Pat. No. 4,405,257) discloses a compartmentalized safety mat which may be filled with cement. The mat has an undulating or wavy surface with a checker board pattern of alternating domed and flat squares.

Nishizawa et al (U.S. Pat. No. 3,561,219) disclose a woven mat-like structure having adjacent, parallel, continuous tubular compartments filled by pumping in a slurry of water, sand and gravel. Concrete mix as filler is not taught, and consequently, the mats of Nishizawa et al lack required structural values for use as terranean building materials. According to Nishizawa et al, asphalt mats and concrete blocks have been used in bank revetment or coast protection works, but were found to be unsatisfactory from the point of view of working efficiency and mechanical properties.

Lamberton (U.S. Pat. No. 3,837,169) discloses an erosion control matress with elevated bulbous shaped structures. The matress comprises two sheets of flexible material with a plurality of cords interconnecting between the interior surfaces of the sheets. Concrete filler is continuous in the interior of the matress which is not compartmentalized, and therefore, should lack the desired flexural characteristics.

Heine et al (U.S. Pat. No. 3,696,623), like several others mentioned above relate to a structure employed in controlling erosion in waterways, shore lines, beaches, and lacks the required structural values needed for use as a unit of construction for roadways, building applications, supporting structures, and particularly in ply concrete construction. The woven mats of U.S. Pat. No. 3,696,623 comprise a network of open weave bags which are spaced from one another. The tubed mats are filled with thermoplastic materials.

Accordingly, it would be highly desirable to have a versatile concrete mat-like unit with improved structural values, including enhanced load bearing properties and resistance to fracturing achieved through ply concrete construction which adds flexural characteristics and residual strength to concrete bodies not otherwise attainable with poured concrete.

SUMMARY OF THE INVENTION

Accordingly, it is a principal object of the invention to provide for novel, highly versatile concrete construction units. The units which posses enhanced load bearing properties are in the form of a mat or rug-like structure and are comprised of a closed, water permeable outer shell which is substantially impermeable to concrete aggregate. The outer shell is subdivided into a plurality of connected, adjacent, parallel, tubular compartments which are filled with a sufficient quantity of a cementitious material to provide individual, longitudinally uniform concrete bodies segregated from one another. The concrete bodies although segregated are nevertheless sufficiently close as to provide nip and void-like areas between immediately adjacent bodies, especially prior to wetting. The porosity of the outer shell loading and compacting of cementitious material therein is conducted so as to effectuate controlled wetting of the material.

It is also a further object of the invention to provide a concrete construction unit having an outer shell which is substantially impermeable to concrete mix when in a dry state, but with chemical hydration slurried concrete values are able to diffuse from the interior to the exterior of the shell for bonding the wetted/hydrated concrete bodies into a substantially rigid unit. It is therefore an objective of this invention to provide for a concrete construction unit with —controlled chemical hydration— which is intended to mean the ability to absorb sufficient amounts of water through the outer shell to fully moisten the mat without manually working or kneading for maximizing overall strength and load bearing properties with curing, while also having the ability to release excess water, particularly with the application of compressive force.

It is yet a further principal object to provide for multi-ply concrete construction composites which flex comprising a plurality of the concrete mat-like construction units arranged in spaced planes which are parallel to each other, and separated by a layer of cementitious material. The multi-ply concrete composites are homogeneous, monolithic like structures. The concrete construction units and their use as multi-ply composites are adaptable to a wide variety of building applications including, but not limited to road beds, driveways, walkways, foundations for buildings and clay beds for waste dumps, prefabricated wall panels, floors, roofing tiles, domes, support columns, bridge supports, abutments, and the like. Advantageously, the concrete construction units and their applications through multi-ply composites eliminate the need in most instances of costly forms required with poured concrete construction.

It is still a further object of this invention to provide a method for constructing a flexible multi-ply composite structure by the steps of:

(a) providing a plurality of the mat-like concrete construction units previously described;

(b) applying a first concrete construction unit to a supporting base, the first concrete construction unit being wetted sufficiently to effectuate chemical hydration;

(c) applying sufficient cementitious material to the first concrete construction unit to at least fill the region of the nip and void-like areas of the construction unit to provide a first ply;

(d) applying at least a second concrete construction unit to the first ply, the second concrete construction unit being wetted sufficiently to effectuate chemical hydration of the cementitious material therein;

(e) applying sufficient cementitious material to the second concrete construction unit to at least fill the region of the nip and void-like areas between the filled compartments to provide a second ply, and (f) compressing the plies into a composite structure.

These and other objects, features and advantages of the invention will become more apparent from the detailed written description below. However, for a further understanding of the invention, reference is first made to the accompanying drawings taken in conjunction with the detailed written description wherein:

FIG. 1 is a perspective view of one embodiment of a mat-like concrete construction unit in which individual filled tubular compartments run with the longitudinal axis of the mat.

FIG. 2 is a perspective view of an alternative embodiment of the concrete construction unit of FIG. 1, wherein the filled tubular compartments run transverse to the longitudinal axis of the mat.

FIG. 3 is a sectional view of the concrete construction unit taken along line 3—3 of FIG. 1.

FIG. 13 is a hollow dome shaped enclosure employing multi-ply concrete construction with parts removed to show the layered wrap around construction.

FIG. 14 is an alternative embodiment of the hollow dome enclosure with, parts removed to show segmented construction.

FIG. 15 is a top view of the finished dome of FIG. 14.

FIG. 16 is a segmented concrete construction unit employed in the hollow dome of FIGS. 14 and 15 comprised of horizontally oriented plies.

FIG. 17 is a segmented concrete construction unit like that of FIG. 16, except with vertically oriented plies.

DETAILED DESCRIPTION OF THE INVENTION

Figure 4:
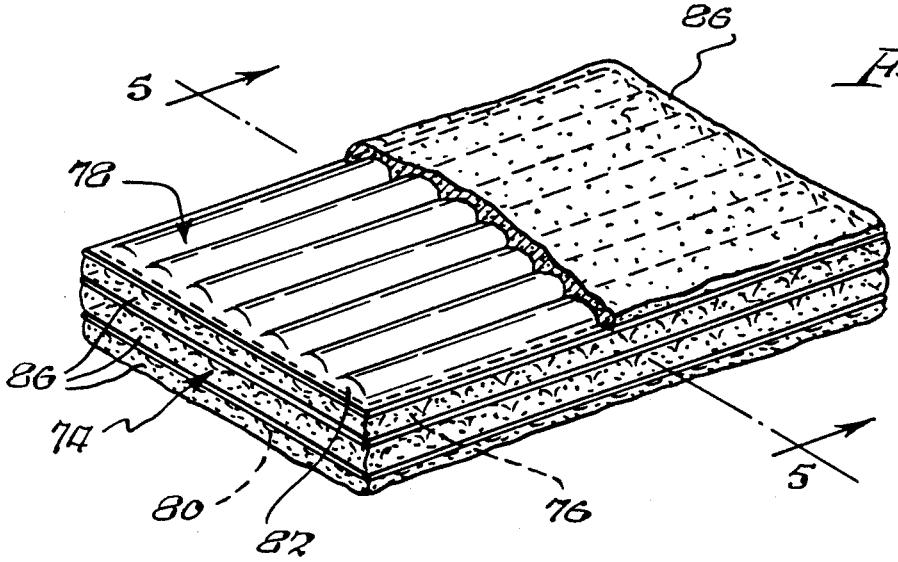
FIG. 4 is a perspective view of a concrete construction unit as employed in a multi-ply composite structure with cross graining and part of its outer concrete layer removed.

Turning first to FIG. 1, there is shown concrete construction unit 10 which in outward appearance resembles a matress, mat or rug-like structure. Construction unit 10 generally comprises an outer shell 12 subdivided into a plurality of parallel tubular compartments 14 which are filled with a dry concrete material 16 (FIG. 3), usually a mix comprising cement and concrete aggregate, typically sand and gravel suitably packed in compartments 14 as to enhance complete chemical hydration of the dry mix without "flooding" when the shell is contacted with water. The filled compartments set-up and cure into solid, longitudinally uniform concrete bodies closely aligned with one another. Prior to setting-up a certain amount of slurried concrete values can diffuse to the outer surface of the construction unit converting it into a substantially rigid structure with curing.

Preferably, outer shell 12 is fabricated from cloth or fabric, but may also be prepared from flexible, porous or perforated polymeric films, such as polyolefins, like polyethylene or other low cost thermoplastic films, in each instance of sufficient strength and durability that the construction unit does not rupture or split during storage, conveyance and installation.

Various single and double ply woven and nonwoven relatively light weight fabrics are preferred for the outer shell. This would include durable cottons, jute, hemp, duck, light weight canvas, and the like, as well as synthetics and blends of natural and synthetic fibers, like cotton and polyester blends. Woven cottons, like muslin are especially preferred because of their durability, wettability properties and low cost. In each instance, the weave of the cloth outer shell should be sufficiently close, and the openings in the synthetic film be of such dimension as to permit storage and shipping of the filled construction units without loss of dry mix prior to wetting. Likewise, the porosity of the outer shell should allow water to readily pass through the weave or openings during wetting without manually kneading to assure complete hydration of the dry concrete mix core, and also allow some slurried concrete values to diffuse outwardly from the shell to aid in the formation of a rigid unit of construction upon curing.

Outer shell 12 is comprised of a plurality of dimensionally uniform parallel compartments 14 of unspecified length as shown in FIG. 1, where they run with the longitudinal axis of the mat. Concrete construction unit 10 may actually be of any dimension, i e. length and width, which can be conveniently stored and transported to the construction site while also meeting the needs of the particular use application. This would also include ease of handling. In this regard, the mat-like construction units can be coiled onto rod member 18 or equivalent spool device for convenience in storage and transporting to construction sites where they are unrolled and applied to a prepared bed or foundation, such as gravel, stone or sand (not shown).

Although compartments 14 (FIG. 1) running with the longitudinal axis of the mat may be any convenient length, compartment diameters are generally from about 1 to about 4 inches, and more preferably, from about 2 to about 3 inches to permit water to penetrate the interior core of the dry concrete mix. Accordingly, outer shell 12 comprises a lower panel 20 and upper panel 22 initially joined together on three contiguous peripheral edges 24, 26, 28 to form an envelope-like structure. Panels 20 and 22 are joined at their edges by peripheral stitches 30.

The envelope is subdivided into individual tubular compartments 14 by means of rows of parallel stitches 32 running with the longitudinal axis of the construction unit (FIG. 1) joining the upper and lower panels together. Preferably, stitches 32 comprise single rows of machine sewn stitches running the length of the mat. With single rows of stitches subdividing construction unit 10 into multiple compartments, adjacent filled compartments will be in virtual abutment with one another, as best illustrated at FIG. 3, when filled with dry concrete mix. The only actual separation between adjacent concrete bodies will be outer shell 12 and the single row of longitudinal stitches 32. When the compartmentalized envelope is packed with dry concrete mix and the fourth peripheral edge sewn closed the compartments should assume a uniform cylindrical or rod shaped configuration with nip and void-like areas 34 and 36 (FIG. 3), respectively. The rod shaped bodies are best prepared by complete filling of the outer shell compartments. Tubular bodies are tightly filled so as to remove substantially all slack forming the outer shell.

Tubular compartments 14 may be filled by charging with any of the known dry concrete mixes, typically comprising cement and aggregate, like natural sands and gravel, crushed stone, including any of the light weight aggregates manufactured from clays, shales, slates and slag, especially for improved thermal and acoustical insulating properties. However, for optimum strength a greater proportion of stone aggregate would be employed.

By densely filling tubular compartments 14 with dry cementitious material 16 —controlled chemical hydration— is also achieved. With compartments densely filled there is minimal residual slack in the outer shell, and excess water is unable to readily penetrate and spontaneously "flood" the compartments. By limiting the diameter of the filled tubular compartments as previously described, and by full and complete filling of the compartments with dry mix there is a built-in mechanism for automatically controlling amount of water entering the compartments during hydration. A further advantage of this invention is that by restricting the volume of water entering filled compartments strength and durability properties of the construction unit are enhanced overall. That is, with excess water added to the dry concrete mix compression and flexural properties are reduced. Hence, according to the present invention controlled volumes of water enter the outer shell to hydrate the cementitious core to form the desired paste mixture for surrounding the aggregate components of the concrete mix, but at a lesser proportion than would be employed with poured concrete for improved physical properties. In addition, with compression of the mat after placement at the construction site some slurried concrete values may "bleed" from the shell interior and collect in the nip and void areas of the unit transforming the pliable mat into a substantially rigid structure with curing.

FIG. 2 illustrates an additional embodiment 38 of the concrete construction unit. This mat-like structure also comprises an outer shell 40 with a lower panel 42, an upper panel 44 fastened together along their peripheral edges by means of stitches 46 or heat seal in the case of an outer shell of thermoplastic film. The shell is subdivided into a multiplicity of continuous, cylindrically shaped, parallel compartments 48 by single rows of stitches 50 or a narrow heat seal running transverse to the longitudinal axis of the unit. The individual compartments are firmly filled with a dry concrete mix and sewn closed at the filling end for effectuating controlled chemical hydration. This further embodiment has its adjacent wrapped concrete bodies in close abutment with one another forming nip and void areas like those illustrated in FIG. 3.

As previously indicated, proper hydration of the concrete construction units is regulated by factors of compartment diameter and packing density of the dry mix in the compartments. A relatively small diameter compartment assures complete penetration of moisture into the core of the dry mix at the time of hydration without manual kneading while a high packing density or tightly confined mix protects against large excesses of water entering the compartments and reducing desirable structural properties, including bonding characteristics and ability to withstand compressive forces without fracturing.

With the present invention employing the concept of —controlled chemical hydration—less water need be used than normally required for a comparable volume of poured concrete. Since flow properties of the hydrated concrete mix are not a consideration with the concrete construction units of the present invention use of less water in hydrating the mix means enhanced structural properties. However, in the unlikely event any significant excess volumes of water enter the compartments removal can be easily effectuated by weighted rollers or equivalent means being rolled over the unit expressing excess moisture from the concrete core.

In spite of some slurried concrete values and excess water diffusing from the shell of the concrete construction units with application of compressive forces the concrete cores remain well intact and confined within their individual compartments making the units highly versatile "building blocks" for the construction industry. They can be physically shaped into virtually any configuration without the usual restrictions experienced with poured concretes, the later of which are dependent on sufficient water being added for acceptable flow characteristics. With poured concrete this, however, means compromising structural properties, as well as tradeoffs in time, materials and labor cost in construction and removal of forms. Because the concrete construction units disclosed herein can be compacted after hydration and installation at the construction site they can be employed advantageously where specifications call for higher density concretes, such as in buildings, shelters, shielding devices and screens where there is a potential for harmful radiation, including erosion and penetration of concrete by chemicals, such as road salts.

As an extension of the above compressibility characteristic, the concrete construction units disclosed herein can also be employed as monolithic type composite structures possessing extraordinary strength and durability. Preferably, the concrete composites are multi-ply structures comprising a plurality of the concrete construction units. As multi-ply composites they possess properties which resist fragmentation under load an impact, deflecting forces similar to the graining effect provided by wood, and particularly when several layers or alternating cross plies form a composite structure, analogous to laminated plywood. With fracturing of multi-ply concrete composites immediate loss of structural values is forestalled due to its ability to flex.

Figure 7:
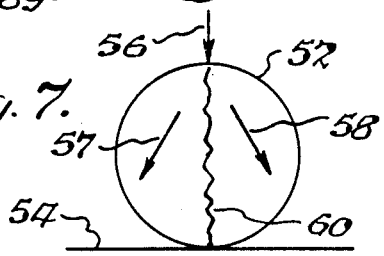
FIG. 7 is a vector diagram showing the distribution of forces in a single poured concrete monolithic structure.
Figure 8:
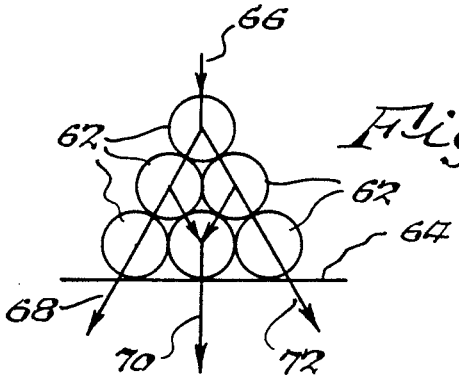
FIG. 8 is a comparative vector diagram illustrating the concept of multi-ply concrete, and how forces are deflected among a plurality of concrete bodies in a composite.

The above concept is best illustrated by reference to FIGS. 7 and 8. FIG. 7 demonstrates an end view of a solid monolithic concrete rod 52 seated on foundation 54. A force 56 is impacted against rod 52. The energy from the force is deflected as shown by force vectors 57 and 58 through the single rod. Stress applied to rod 52 is not transferred to or offset by any other bodies or the foundation, but is absorbed by the rod causing it to spontaneously fracture along line 60 through the entire mass. All structural value is immediately lost. In comparison, FIG. 8 demonstrates the concept of multi-ply construction according to the present invention where a substantial equivalent volume of concrete as employed in rod 52 (FIG. 7) is subdivided into five individual rods 62, and layered into a pyramidal structure on foundation 64. A force 66 is impacted against the single, uppermost solid concrete rod. But instead of immediately fracturing, stress is deflected to the other rods of the stack as shown by force vectors 68, 70 and 72. The force is deflected without any fractures.

Figure 5:
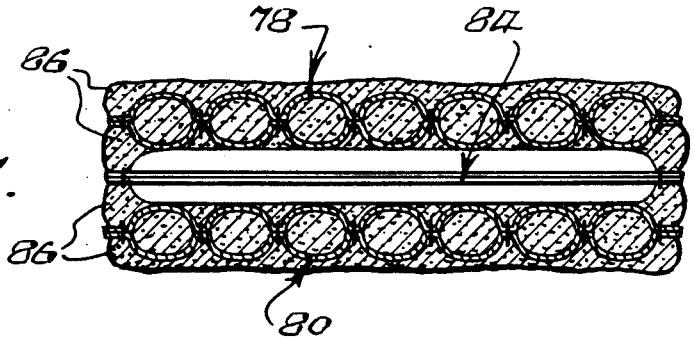
FIG. 5 is a sectional view of the multi-ply concrete composite taken along line 5—5 of FIG. 4.

FIGS. 4 and 5 illustrate a preferred embodiment of a multi-ply composite structure 73 with cross grained plies comprising individual concrete construction units as plies superimposed one on top of the other, spaced apart so they lie in separate, but parallel planes. Lower and upper concrete construction units 74 and 78 of any required length have their concrete bodies 80 and 82 running in the same direction whereas the concrete bodies 84 of intermediate concrete construction unit 76 run transverse to upper and lower concrete construction units 78 and 74. The upper and lower concrete construction units 78 and 74 may be conveniently fabricated from the units illustrated in FIG. 1. Intermediate unit 76 may be fabricated from the mat shown in FIG. 2.

In fabricating multi-ply composites the space between each hydrated concrete construction unit is filled with a layer of cementitious material 86, preferably a mortar or grout paste. Preferred materials include mixtures of water, cement and sand and/or gravel trowled over the face of each ply filling their nip and void areas. The mortar should also be spread evenly and sufficiently thick to completely fill the nip and void areas of the underside of the next adjacent concrete construction unit, as well as the exterior surfaces of the composite.

Figure 6:
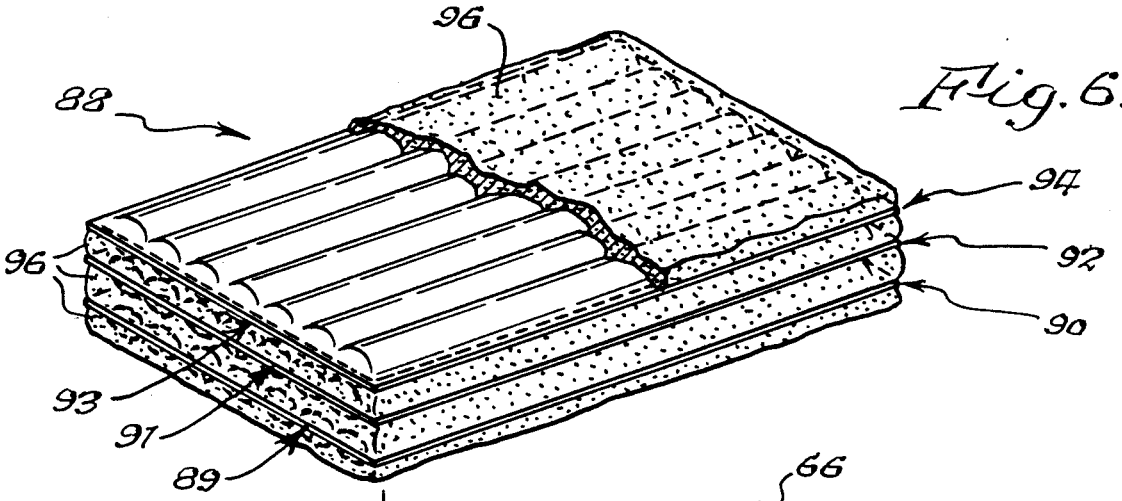
FIG. 6 is an alternative embodiment of the multi-ply composite with parallel graining in which bodies of the concrete construction units run with the longitudinal axis of each mat.

FIG. 6 discloses an alternative embodiment 88 of the multi-ply concrete composite with parallel graining in which concrete bodies 89, 91 and 93 of construction units 90, 92 and 94, respectively run in the same longitudinal direction. The individual plies of the composite are filled with concrete or mortar 96, including the outer surfaces.

It will be understood that the multi-ply composites are not limited to any specific number of plies, i.e. three plies as shown in the drawings. The composites will consist of at least two plies, however, the ultimate number of concrete construction unit plies will depend on the structure being fabricated, and service requirements. For example, a composite for supporting a clay bed for a toxic waste dump typically can employ three or four layers having one inch thick plies running transverse to the next adjacent ply, i.e. cross grain plies. Alternatively, two 2 inch thick plies may be employed running perpendicular to one another.

In the construction of pavements, e.g. roads, driveways, walkways, runways, containment pads for storage tanks, and the like, with multi-ply concrete composite structures spools of dry filled concrete construction units like those of FIGS. 1 and 2 are delivered to the construction site. On a prepared foundation, for example, stone, gravel and/or sand, etc., an initial base ply of the dry concrete construction unit is layed down, hydrated in-situ with a sprinkler and a coating of approximately ¼ to ½ inch of dry or wet concrete comprising cement and aggregate is applied directly to the top of this first base ply. If a dry concrete is used it is wetted before a second ply is placed into position. The second ply may then be placed over the base ply and concrete coat so the concrete tubular bodies of each ply run substantially perpendicular to one another, as shown in FIGS. 4 and 5. The second ply is then hydrated with water. A top coat of mortar or concrete (wet or dry) of about ½ inch thick is trowled over the surface of the second ply. A 200 to 300 pound roller is applied to the wet structure in order to compress the plies into a monolithic, homogeneous structural composite. Additional plies can be added onto the multi-ply pavement composite as more loading strength is required. The required number of plies will be apparent to persons of ordinary skill. This multi-ply composite pavement has the advantage over poured concrete by providing protection against erosion and chemical (salt) penetration as result of higher density; including protection from fracturing under heavy loads because of residual strength resulting from flexible characteristics and greater tolerance to weather conditions, e.g. freeze and thaw conditions.

Figure 9:
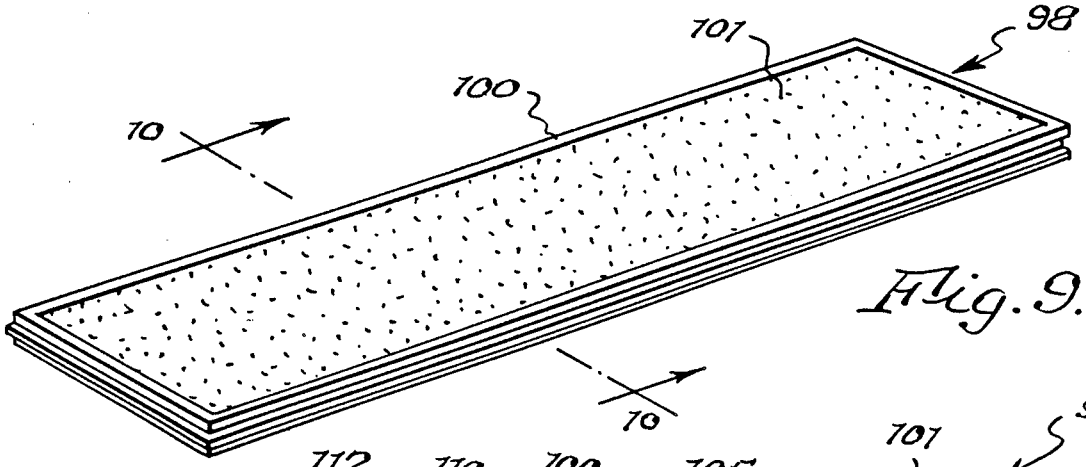
FIG. 9 is a perspective view of a finished wall panel employing multi-ply construction as the panel core (not shown).
Figure 10:
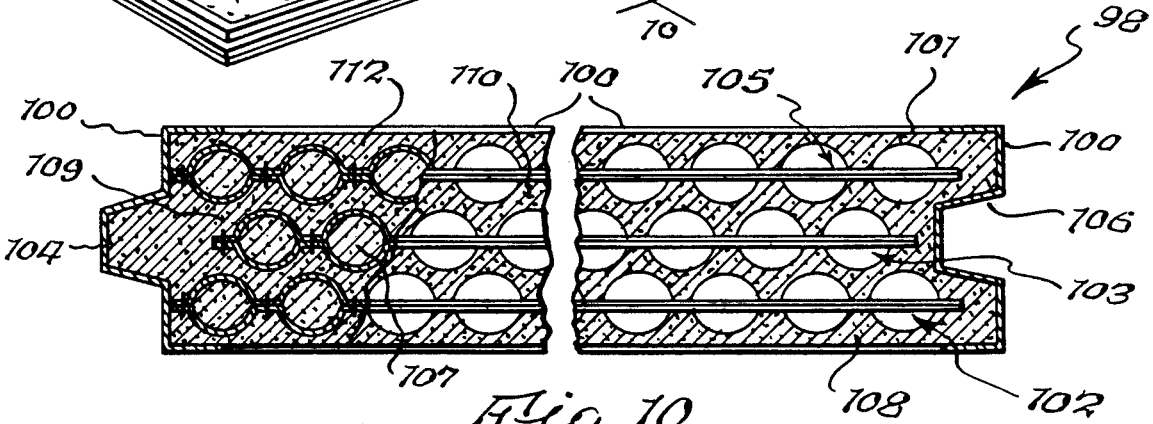
FIG. 10 is a sectional view of the interior of the wall panel taken along line 10—10 of FIG. 9.

Further applications for the concept of multi-ply concrete composites include wall panels 98 (FIG. 9) based on layered plies arranged in a frame 100 and optionally finished with an exterior layer of decorative and functional material, e.g. stucco or mortar 101. The underside of wall panel 98 may also be similarly finished. Individual plies (FIG. 10) are positioned in the interior of frame 100 so they run parallel with the longitudinal axis of the unit for maximizing structural support. This composite structure preferably utilizes parallel graining of the type shown in FIG. 6.

Wall panels 98 may be comprised of a rectangular frame 100 with an outer tongue 104 and groove 106 for interlocking with adjacent wall panels and/or panel supports of conventional design (not shown). The wall panel composites comprise an initial outer layer of mortar 108 followed by a first concrete construction unit 102 running the length of the frame, and also filling the entire width of the frame. The concrete unit may be hydrated in-situ or immediately before installing in the frame. A second layer of mortar 109 surrounds the surface of the first concrete construction unit 102. A second or intermediate concrete construction unit 103 is superimposed over the second layer of mortar. The concrete bodies 107 of construction unit 103 may also have slate, shale, clay or functionally equivalent materials added to the dry concrete mix for upgrading insulating properties. Other plies of the composite may also have such insulating materials added. A third layer of mortar 110 is applied over second concrete construction unit 103, followed by third concrete construction unit 105. An outer coating of mortar 112 is troweled over the third concrete construction unit. The panel is then compressed into a monolithic, homogeneous structure and finished with a decorative outer coating of stucco or mortar 101 on one or both sides. The longitudinally arranged concrete bodies and intermediate layers of mortar between the construction units provide excellent load bearing properties to the prefabricated wall panels for building construction.

Figure 11:
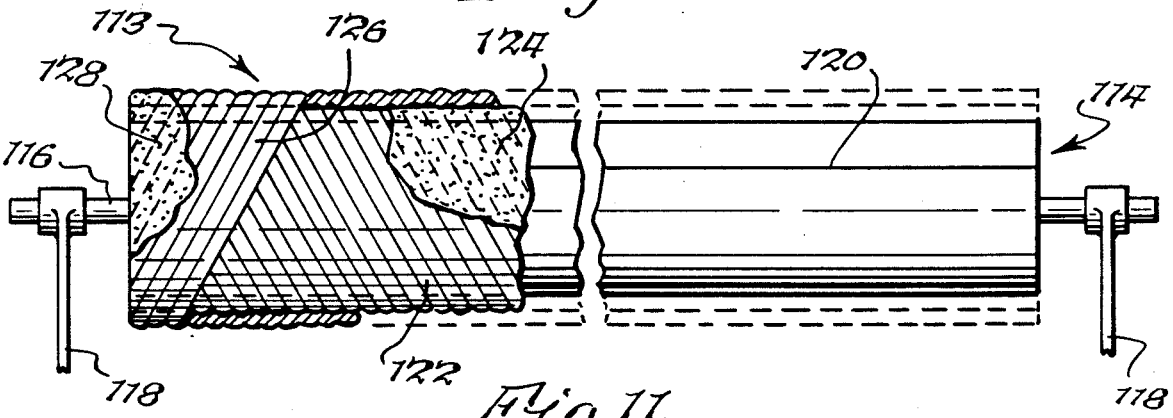
FIG. 11 is a horizontal view of a cylindrical support column having multi-ply construction with rug unit plies wound on a reusable template.

The concrete construction units are also pliable, and can be shaped into a wide range of tubular structures, including economic concrete containment forms which serve as replacements for conventional molds in fabricating support columns, pillars and poles for bridges, highways, and the like. Structures may be of any appropriate shape and diameter needed for supporting buildings, bridges and highways. Representative support columns include those of FIGS. 11 and 12. FIG. 11 also shows a device for fabricating cylindrically shaped support structure 113, and comprises a semi-rigid reusable cyclindrically shaped template 114 supported for rotation on a centrally mounted axle 116 and support arms 118. Template 114 preferably includes a collapsing joint of conventional design running the length of the device for unlocking and reducing the diameter of the template wall allowing it to be readily removed from the interior of the load bearing device after concrete set-up. Template 114 is reusable after removal from support structure 113, reexpanding the device and relocking the collapsing joint.

A first ply consisting of a concrete construction unit 122 is spirally wrapped over the surface of the template. The wound unit is hydrated and a coating of moistened concrete or mortar 124 applied. A second ply in the form of a concrete construction unit 126 is spirally wound over concrete coating 124 of the first ply, but as a cross-ply to the first ply so the concrete bodies of the construction units run transversely to one another for added strength. The second ply can be hydrated in-situ, an outer coating of concrete 128 applied thereto, and compressed into a homogeneous, monolithic shell for a support column. Additional optional plies, including steel reinforcements (not shown), such as screening can be wrapped around one or more plies for even greater support.

Figure 12:
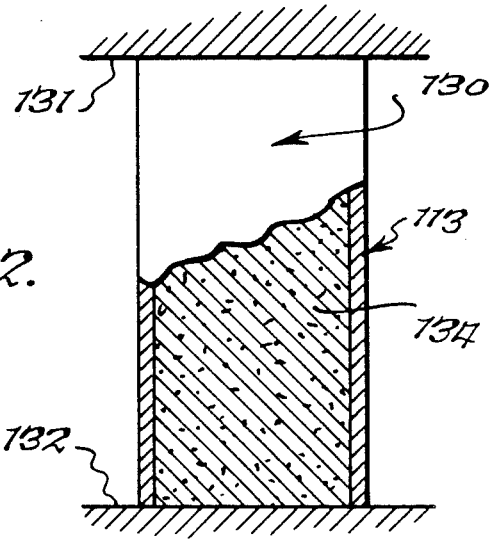
FIG. 12 is a vertical view of an installed multi-ply support column with part of the outer wall multi-ply composite removed for showing concrete core.

After curing, cylindrical support structure 113 is removed from template 114 and transported to the construction site for installation, for example, as a vertical support 130 for bridge 131 (FIG. 12). One end of cylindrical support 113 is seated in foundation 132. Concrete mix 134 is then poured into the interior of the support and allowed to set and cure into a solid supporting column. Accordingly, multi-ply concrete composite construction can also be adapted to round or even elliptically shaped bodies which serve in structural as well as in molding capacities.

Other useful structures employing multi-ply composite construction include utility poles for eliminating metal and electrical interference. As substitutes for wooden utility poles they also eliminate maintenance costs due to insect and moisture damage. Multi-ply monolithic composites may also be employed as liners for foundry vessels.

Particularly useful applications also include dome shaped hollow structures as low cost weather resistant storage shelters (FIGS. 13–17). FIG. 13 illustrates the multi-ply concrete construction of dome 135 with plies partially removed to show wrap around construction. A concrete foundation 136 supports an assembled, removable form 138. First ply 140 consisting of concrete construction units is wrapped around form 138 at an oblique angle spiralling from the foundation in an upward direction. After hydrating, the mat-like first ply is covered with a layer of mortar followed by a second ply 142 of concrete construction units preferably layered by wrapping around in a direction cross or transverse to first ply 140. The second ply can then be finished by rolling and an outer coating of stucco 144 or other decorative concrete material applied.

Alternatively, dome structures may be fabricated by means of segmented construction (FIGS. 14–17). Instead of continuous running plies of construction units wrapped around a form (FIG. 13) separate triangular shaped bodies 148 are assembled on a concrete foundation 146 to provide a removable dome shaped form. Rather than mat shaped concrete construction units, individual segmented, triangular shaped concrete construction units 149 (FIG. 16) are prepared with horizontal concrete bodies 150 as building blocks for the first ply 151. In addition, segmented triangular shaped construction units 152 (FIG. 17) are fabricated with vertical cement bodies 154 as building blocks for second ply 155. A first ply 151 of triangular shaped concrete construction units 149 is applied to form 148, hydrated and coated with a layer of mortar followed by a second ply 155 of triangular concrete construction units 152 having vertically positioned concrete bodies 154. An outer coating of mortar or decorative stucco 156 is applied after the structure is rolled to compress the plies into a monolithic structure. After setting and curing segmented forms 148 can be removed.

EXAMPLE

To compare the structural properties of multi-ply concrete composites with a comparable poured concrete monolithic body the following experiment was conducted.

Sheets of single ply muslin were sewn together to form compartmentalized outer shells similar to FIGS. 1–3, and tightly filled with a dry concrete mix in the proportions of 1 part cement, 1.5 parts sand and 2.5 parts stone (½ #1, ½ #1A). The concrete construction units were sewn closed at the filling end. The construction units each measured approximately 6×6 inches. Two 5-ply cube shaped concrete composites were prepared by hydrating the individual construction units, applying a thin cement and fine aggregate paste over each unit before placing the next ply. Pressure was applied to the 5-ply structures to insure continuous contact between the layers and to form homogeneous composites.

One composite was prepared with parallel graining in which individual concrete bodies of each construction unit ply ran in the same direction (FIG. 6), and was labeled Sample 3. A second composite was prepared like that of Sample 3, except the plies were cross grained (FIGS. 4 and 5). This second composite was labeled Sample 2. Multi-ply composite Samples 2 and 3 were cube shaped, measured about 6 $inch^2$, and were allowed to cure for a total of ten days before testing. Unit weights were about 150 pcf after 7 days of moist curing. The projected 28 day strength was 5,080 psi.

For comparison purposes, a solid 6 $inch^2$ cube of poured concrete was prepared (Sample 1) with the same concrete mix used in Samples 2 and 3. Unit weight was 144 pcf after 4 days moist curing. At the time of testing the solid concrete had aged for a total of 7 days. The projected 28 day strength was 4,240 psi.

Figure 18:
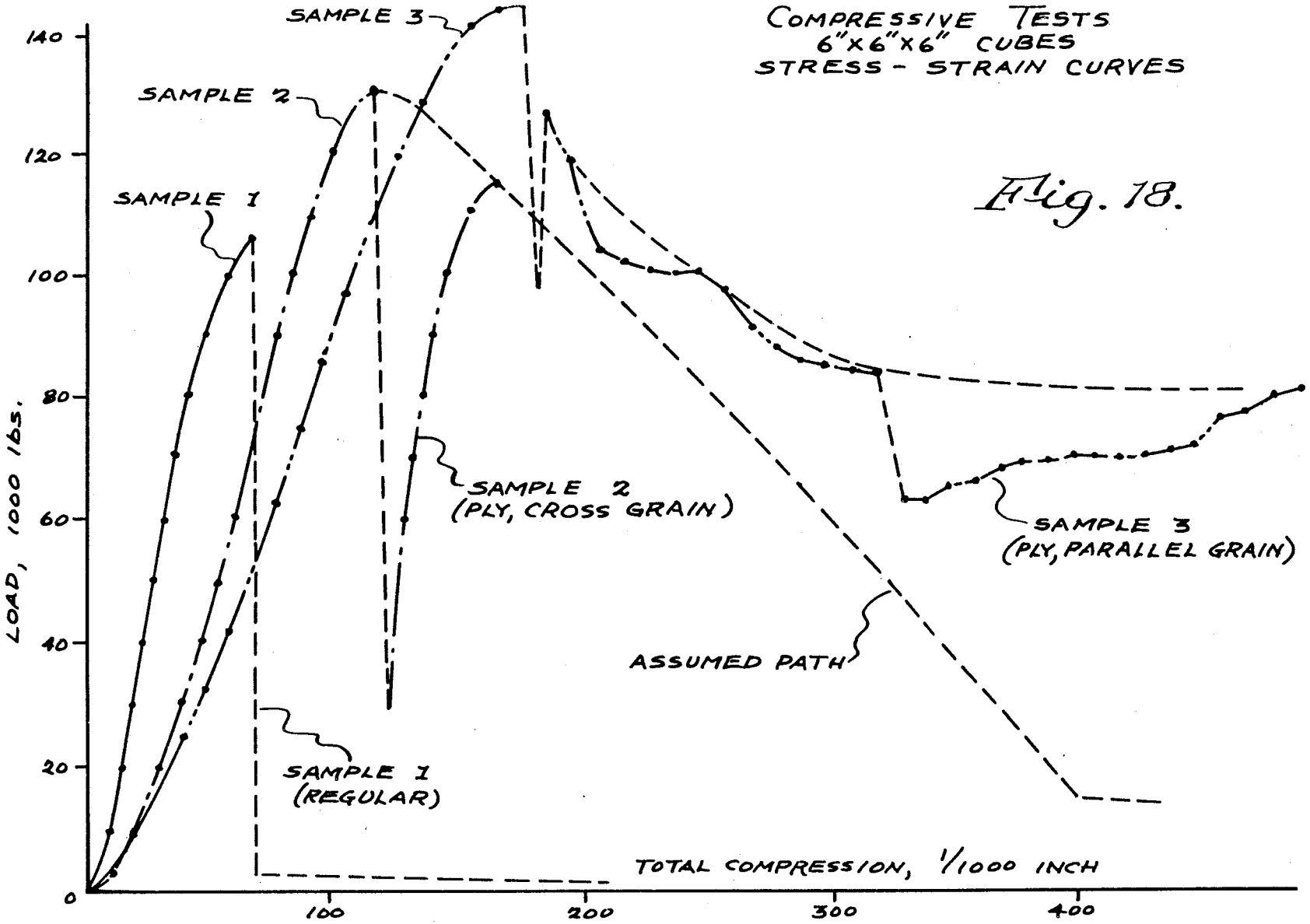
FIG. 18 is a stress-strain curve showing comparatively residual stress values in poured concrete vs. ply concrete composite structures.

FIG. 18 shows the stress-strain curve from compressive testing of Samples 1–3. The curves are labeled to correspond with the sample numbers. Sample 1 showing the performance of the poured concrete sample indicates with 106,000 pound load the concrete started fracturing at which time feed was released. Load was unable to build up to any measurable magnitude when feed was reapplied. Mode of failure was of a typical "hourglass" shape.

In testing the multi-ply concrete composites, Sample 2 having cross grain plies did not fracture until about 129,000 pounds of pressure was applied at which time the load was released. Even after fracturing, when the load was reimposed to the fractured sample pressure of about 115,000 pounds could be applied before final destruction occurred. This demonstrates the residual strength properties of the flexible multi-ply concrete composites of the present invention.

With parallel grain, flexible multi-ply composite (Sample 3) fracturing did not occur until a 140,000 pound load was applied. When the load was reimposed structural value and the ability to support a load occurred until the sample developed a sudden diagonal rupture under 80,000 pound of pressure. Sample 3 also demonstrates residual structural values with flexible, multi-ply concrete composite structures.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

I claim:

1. A concrete construction unit, which comprises a mat-like structure having enhanced load bearing properties making it useful in the construction of walls and wall panels, floors, pavements, road beds, support pads, foundations, domes, roofs, poles, pillars and bridge supports, said mat having a closed, water permeable outer shell which is substantially impermeable to concrete aggregate, said shell being subdivided into a plurality of connected, parallel tubular compartments, said compartments comprising a sufficient amount of a dry cementitious material to provide individual, longitudinally uniform, segregated concrete bodies, said bodies being in an even plane relative to one another, the porosity of said outer shell and packing of said dry cementitious material therein being sufficient to effectuate controlled chemical hydration, said concrete construction unit characterized by formation of a substantially rigid monolithic structure upon curing.

2. The construction unit of claim 1 wherein said parallel concrete bodies are positioned sufficiently close as to provide nip and void-like like areas between said concrete bodies.

3. The construction unit of claim 1 wherein said outer shell is comprised of at least one ply of cloth or porous manufactured film.

4. The construction unit of claim 3 wherein the cementitious material comprises a mix of cement and mineral aggregate.

5. The construction unit of claim 3 wherein the cementitious material comprises a mix of cement and insulating material.

6. The construction unit of claim 3 wherein the cloth outer shell is comprised of cotton, jute, hemp, synthetic fibers or mixtures thereof.

7. The construction unit of claim 3 wherein the cloth outer shell is muslin.

8. The construction unit of claim 6 wherein the cloth outer shell is subdivided with at least one row of stitches running parallel with the longitudinal axis of the tubular compartments.

9. The construction unit of claim 3 wherein the porous manufactured film is subdivided with a seal running parallel with the longitudinal axis of the tubular compartments.

10. The construction unit of claim 1 wherein the porosity of the outer shell is sufficient to permit limited diffusion of slurried concrete values to the outer surface of the shell for bonding the wetted, filled tubular compartments into a substantially rigid unit.

11. A multi-ply concrete composite which comprises a plurality of the concrete construction units of claim 1 positioned in substantially parallel planes and separated from one another by a layer of cementitious material.

12. The multi-ply concrete composite of claim 11 wherein each concrete construction unit provides a ply and the position of each ply is alternated with the next adjacent ply so the longitudinal axes of said units are transverse with one another.

13. The multi-ply concrete composite of claim 11 wherein each concrete construction unit provides a ply and each is positioned so the longitudinal axes of said units are in alignment with one another.

14. The multi-ply concrete composite of claim 13 wherein at least one ply includes a concrete construction unit comprising a mix of cementitious material and insulating aggregate material.

15. A wall panel comprising the multi-ply concrete composite of claim 14.

16. A pavement comprising the multi-ply concrete composite of claim 11.

17. A pavement comprising the multi-ply concrete composite of claim 12.

18. A hemispherical dome comprising the multi-ply concrete composite of claim 11.

19. A support column comprising the multi-ply concrete composite of claim 11.

20. A bridge support comprising the multi-ply concrete composite of claim 12.

21. A method for constructing a multi-ply composite structure which comprises the steps of:

(a) providing a plurality of concrete construction units comprising a mat-like structure having a closed, water permeable outer shell which is substantially impermeable to concrete aggregate, said shell being subdivided into a plurality of connected, parallel tubular compartments, said compartments comprising a sufficient amount of a cementitious material to provide longitudinally uniform, segregated concrete bodies, the porosity of said outer shell and packing of cementitious material therein being sufficient to effectuate controlled chemical hydration;

(b) applying a first concrete construction unit to a supporting base, said first concrete construction unit being wetted sufficiently to effectuate chemical hydration;

(c) applying a layer of cementitious material to the first concrete construction unit filling any void areas between filled compartments of said unit and to provide a first ply;

(d) applying at least a second concrete construction unit to said first ply, said second concrete construction unit being wetted sufficiently to effectuate chemical hydration;

(e) applying a layer of cementitious material to the second concrete construction unit filling any void areas between the filled compartments and to provide a second ply, and (f) compressing the plies into a monolithic structure.

22. The method of claim 21 wherein the concrete construction units of each ply are aligned so their longitudinal axes are substantially parallel with one another.

23. The method of claim 21 wherein the concrete construction unit of one ply is altered relative to the unit of the next adjacent ply so the longitudinal axes of said units are transverse with one another.

24. The method of claim 23 wherein the concrete construction units are positioned so their longitudinal axes are approximately 90° relative to one another.

25. The method of claim 21 including the step of wetting the concrete construction units in-situ.

26. The method of claim 21 including the step of wetting the concrete construction units prior to placing onto the supporting base or as the first ply.

27. The method of claim 21 including the step of providing a supporting base foundation for the first ply.

* * * * *